US007721942B2

(12) United States Patent
Polloni et al.

(10) Patent No.: US 7,721,942 B2
(45) Date of Patent: May 25, 2010

(54) RIGID WRAPPER FOR HOLDING PACKETS OF CIGARETTES

(75) Inventors: Roberto Polloni, Modigliana (IT); Chiara Colo', Fiumalbo (IT); Fiorenzo Draghetti, Medicina (IT)

(73) Assignee: G.D. S.p.A. (IT)

( * ) Notice: Subject to any disclaimer, the term of this patent is extended or adjusted under 35 U.S.C. 154(b) by 2050 days.

(21) Appl. No.: 10/311,432

(22) PCT Filed: Jun. 21, 2001

(86) PCT No.: PCT/IB01/01094

§ 371 (c)(1),
(2), (4) Date: Dec. 18, 2002

(87) PCT Pub. No.: WO01/98179

PCT Pub. Date: Dec. 27, 2001

(65) Prior Publication Data

US 2003/0116612 A1 Jun. 26, 2003

(30) Foreign Application Priority Data

Jun. 23, 2000 (IT) ..... BO2000A0367

(51) Int. Cl.
*B65D 17/32* (2006.01)
*B65D 85/10* (2006.01)

(52) U.S. Cl. ..... 229/243; 206/271; 206/273; 229/110; 229/182.1

(58) Field of Classification Search ..... 229/108, 229/109, 110, 182.1, 240, 242, 243; 206/271, 206/273

See application file for complete search history.

(56) References Cited

U.S. PATENT DOCUMENTS

| | | | | |
|---|---|---|---|---|
| 2,122,480 | A * | 7/1938 | Lowey | 229/232 |
| 3,314,531 | A * | 4/1967 | Cheris et al. | 229/110 |
| 3,467,298 | A * | 9/1969 | Wysocki | 229/110 |
| 3,738,564 | A * | 6/1973 | Persson | 229/110 |
| 3,829,006 | A * | 8/1974 | Spiegel | 229/242 |
| 3,880,342 | A * | 4/1975 | Longo, Jr. | 229/108 |
| 4,676,430 | A * | 6/1987 | Wischusen et al. | 229/242 |
| 4,856,706 | A * | 8/1989 | Van Der Straten | 229/110 |
| 5,107,985 | A * | 4/1992 | Bezrutczyk et al. | 229/110 |
| 5,487,468 | A * | 1/1996 | Sheahan | 229/109 |
| 5,579,989 | A * | 12/1996 | Roy et al. | 229/110 |
| 6,050,402 | A * | 4/2000 | Walter | 206/273 |
| 6,592,023 | B2 * | 7/2003 | Li Vigni et al. | 229/182.1 |
| 6,779,658 | B2 * | 8/2004 | Polloni et al. | 206/271 |

FOREIGN PATENT DOCUMENTS

| | | |
|---|---|---|
| DE | 19912995 | 9/2000 |
| EP | 0891931 | 1/1999 |

* cited by examiner

*Primary Examiner*—Gary E Elkins
(74) *Attorney, Agent, or Firm*—Timothy J. Klima; Shuttleworth & Ingersoll, PLC

(57) ABSTRACT

Packets of cigarettes (2) sold in multiples are wrapped in a rigid carton (1) with a predominating longitudinal axis (L) that extends parallel to the longitudinal axes (7) of the single packets (2) and presents a prismatic shape of polygonal section.

19 Claims, 11 Drawing Sheets

RIGID WRAPPER FOR HOLDING PACKETS OF CIGARETTES

This application is the National Phase of International Application PCT/IB01/01094 filed Jun. 21, 2001 which designated the U.S. and that International Application was published under PCT Article 21(2) in English.

TECHNICAL FIELD

The present invention relates to a rigid wrapper designed to hold packets of cigarettes.

BACKGROUND ART

The term wrapper is used generically to indicate rigid containers known as "cartons" designed to contain packets of cigarettes which, typically, will present a substantially rectangular parallelepiped geometry.

A first type of wrapper appears substantially as flattened parallelepiped with sharp corner edges, referable to a predominating longitudinal axis, internally of which the packets are disposed one alongside and in contact with the next in such a way as to create one or more rows extending along the longitudinal axis.

A second type of wrapper presents a substantially parallelepiped appearance with sharp corner edges and comprises a cupped container, a lid likewise of cupped embodiment, connected to the container by way of a hinge and capable thus of rotating between open and closed positions respectively exposing and concealing an open top end of the container, also a reinforcing frame extending from the open top end, by which the lid is retained when in the closed position. In this type of wrapper the packets are arranged in two rows, breasted in frontal contact one with another, and ordered along respective axes disposed transversely to the vertical axis of the wrapper.

The two types of rigid wrapper outlined above are not suitable for containing packets of cigarettes exhibiting a shape other than that of a rectangular parallelepiped.

The object of the present invention is to provide a rigid wrapper that can be fashioned from a flat diecut blank as simple and inexpensive as possible to produce, such as will accommodate packets of cigarettes presenting a shape quite different from that of a rectangular parallelepiped, and require a relatively modest quantity of wrapping material for its manufacture.

DISCLOSURE OF THE INVENTION

The stated object is realized in accordance with the present invention through the adoption of a rigid wrapper for holding packets of cigarettes, referable to a predominating longitudinal axis extending parallel to the longitudinal axes of the packets of cigarettes, characterized in that it presents a prismatic shape of polygonal section.

The invention will now be described in detail, by way of example, with the aid of the accompanying drawings, in which.

Figure 1:
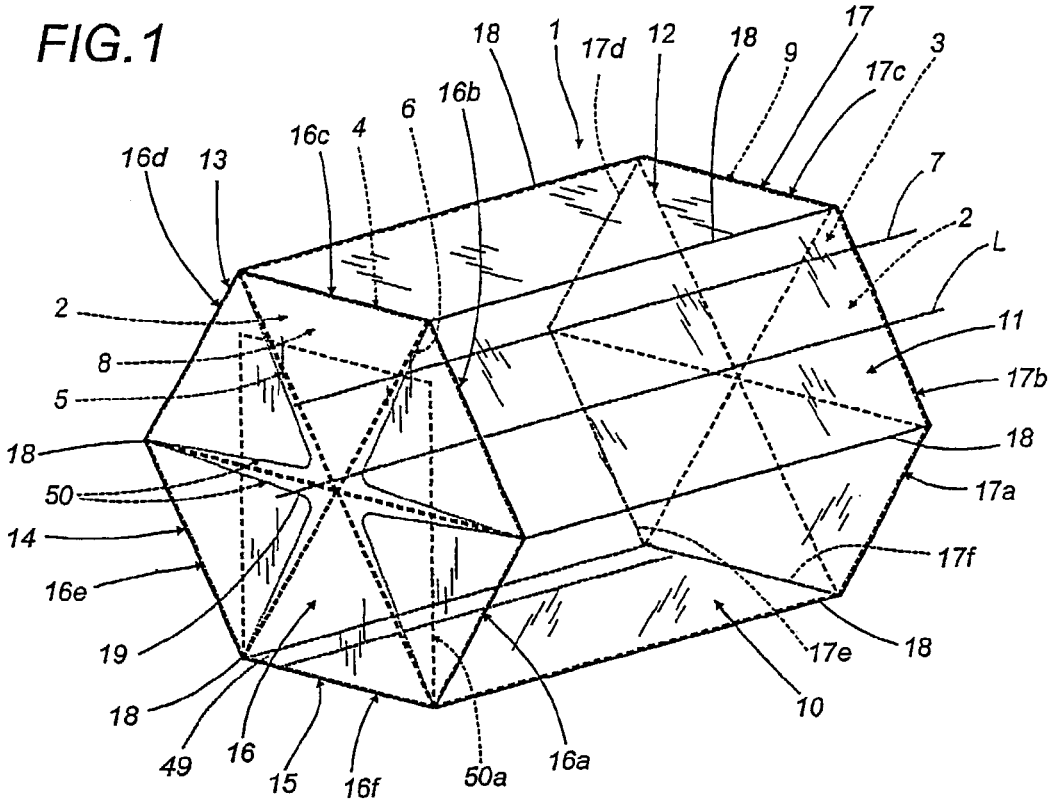
FIG. 1 illustrates a first embodiment of the rigid wrapper according to the present invention, viewed in perspective.

Referring to FIGS. 1, 3, 5, 7, 9 and 11 of the accompanying drawings, 1 denotes a rigid wrapper, in its entirety, designed to hold a plurality of packets 2 of cigarettes of the type, in particular, disclosed in Application BO99A 000681 for Italian patent filed Dec. 15, 1999, to which reference may be made for a full description; the individual packet 2 comprises an outer wrapper 3 appearing as a prism of substantially triangular section, hence with three substantially rectangular adjoining side faces denoted 4, 5 and 6, extending parallel to a predominating longitudinal axis 7 of the prism, and two substantially triangular end faces 8 and 9.

The wrapper 1, which presents a predominating longitudinal axis L disposed parallel to the axes 7 of the packets 2 of cigarettes, is prismatic in shape and of polygonal section, presenting six substantially rectangular longitudinal adjoining side faces 10, 11, 12, 13, 14 and 15 extending parallel to the predominating longitudinal axis L, and two end faces 16 and 17 constituting the ends of the wrapper 1, which are disposed transversely to the six longitudinal side faces 10, 11, 12, 13, 14 and 15.

Figure 3:
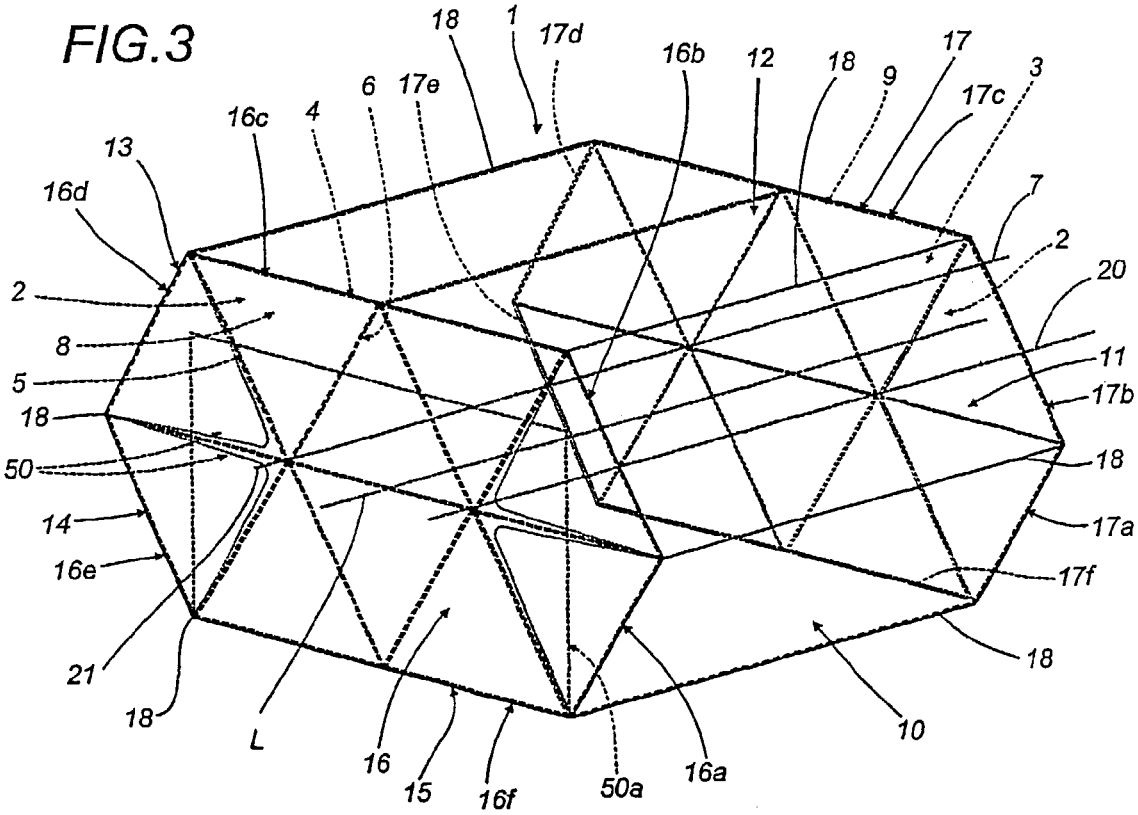
FIG. 3 illustrates a second embodiment of the rigid wrapper according to the present invention, viewed in perspective.

Observing the wrappers 1 of FIGS. 1 and 3, both appear with the six side faces 10, 11, 12, 13, 14 and 15 joined along sharp corner edges 18, and in particular, the wrapper 1 of FIG. 1 presents two end faces 16 and 17 of regular hexagonal shape of which the relative sides 16*a*-17*a*, 16*b*-17*b*, 16*c*-17*c*, 16*d*-17*d*, 16*e*-17*e* and 16*f*-17*f* are identical, whereas the wrapper 1 of FIG. 3 presents two end faces 16 and 17 of irregular hexagonal shape and two side faces, denote 12 and 15 respectively, exhibiting a transverse dimension substantially twice that of the remaining faces 10, 11, 13 and 14; accordingly, the corresponding sides 16*c*-16*f* and 17*c*-17*f* of the end faces 16 and 17 are twice the length of the other sides of the selfsame end faces 16 and 17.

Figure 5:
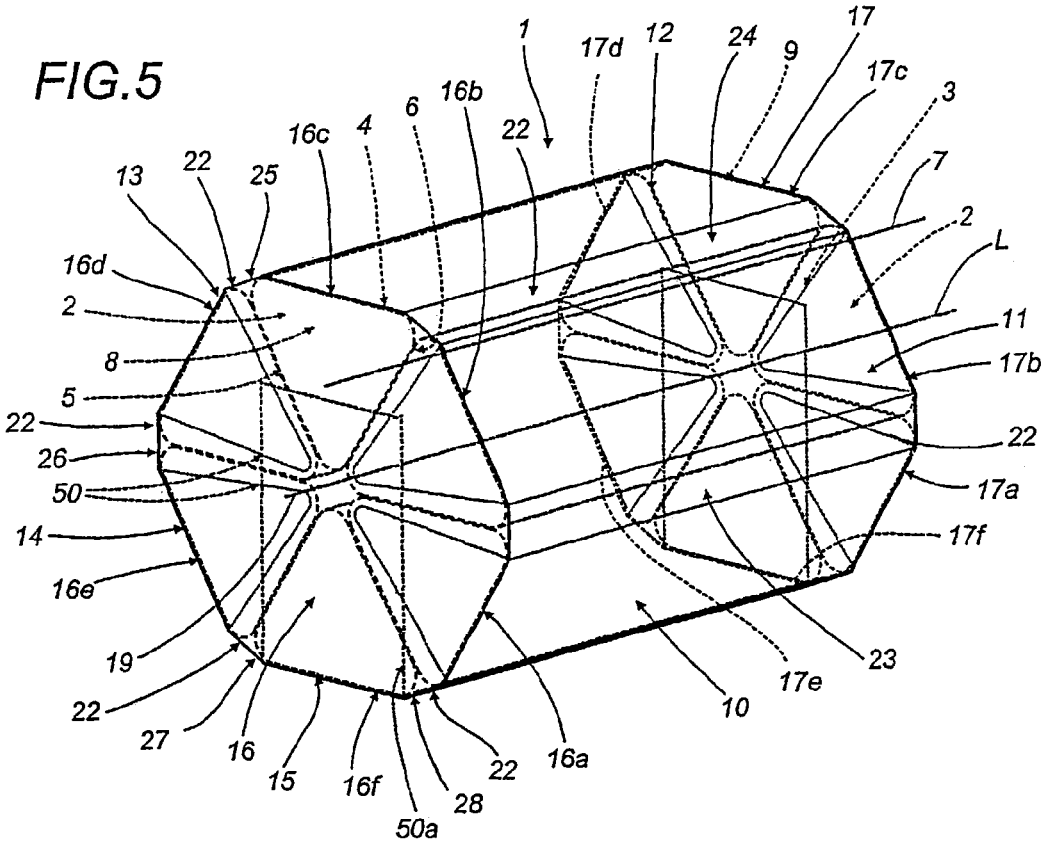
FIGS. 5 and 7 show two alternative embodiments of the wrapper of FIG. 1, viewed in perspective.
Figure 7:
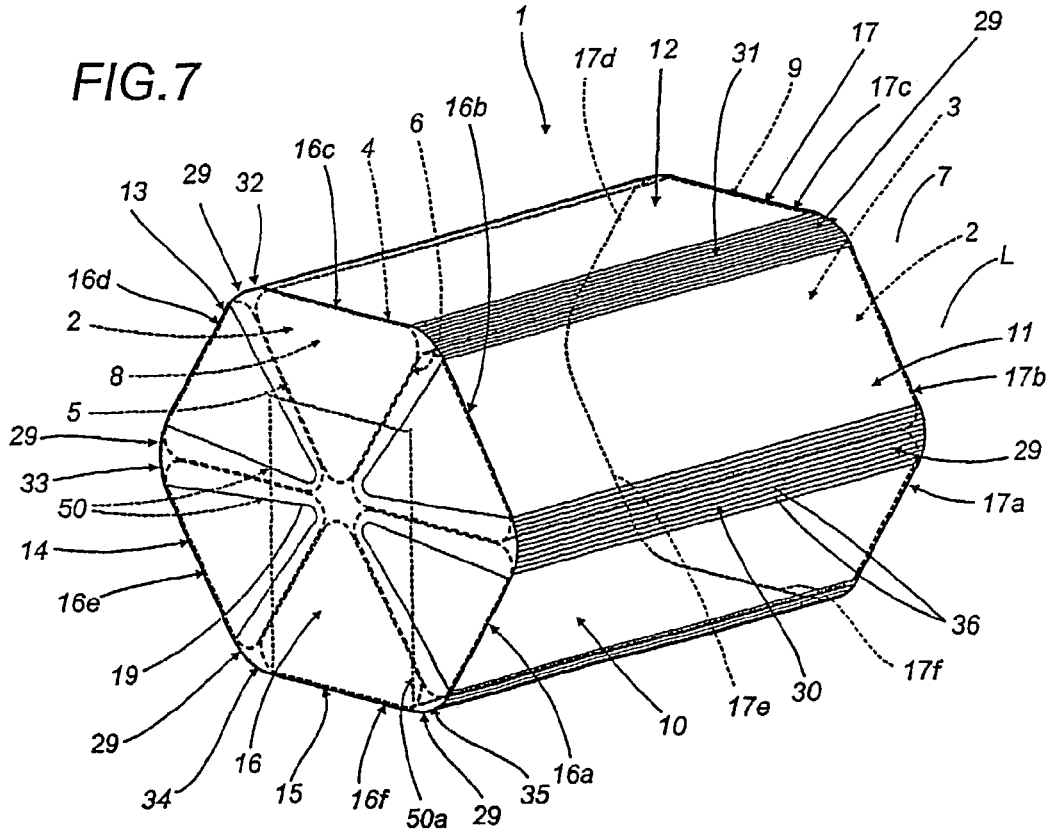

In particular, observing FIGS. 1, 5 and 7, the packets 2 are arranged inside the wrapper 1 each with two side faces 5 and 6 offered to those of other adjacent packets, and the third side face 4 offered to the inside of one of the six faces 10, 11, 12, 13, 14 and 15 of the wrapper 1, in such a way as to form a group of six packets 2 extending parallel with an axis 19 which, in the particular case in point, coincides both with the axis of the wrapper 1 and with the aforementioned predominating longitudinal axis L.

Figure 9:
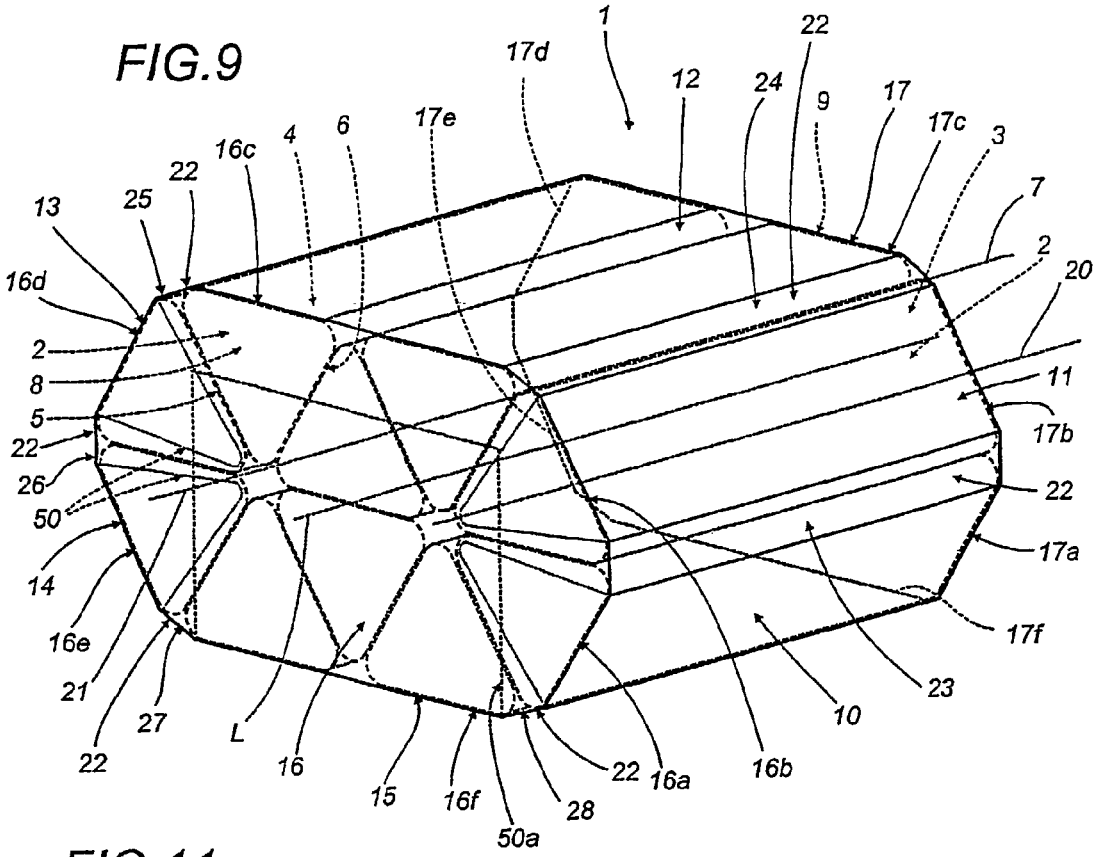
FIGS. 9 and 11 show two alternative embodiments of the wrapper of FIG. 3, viewed in perspective.
Figure 11:
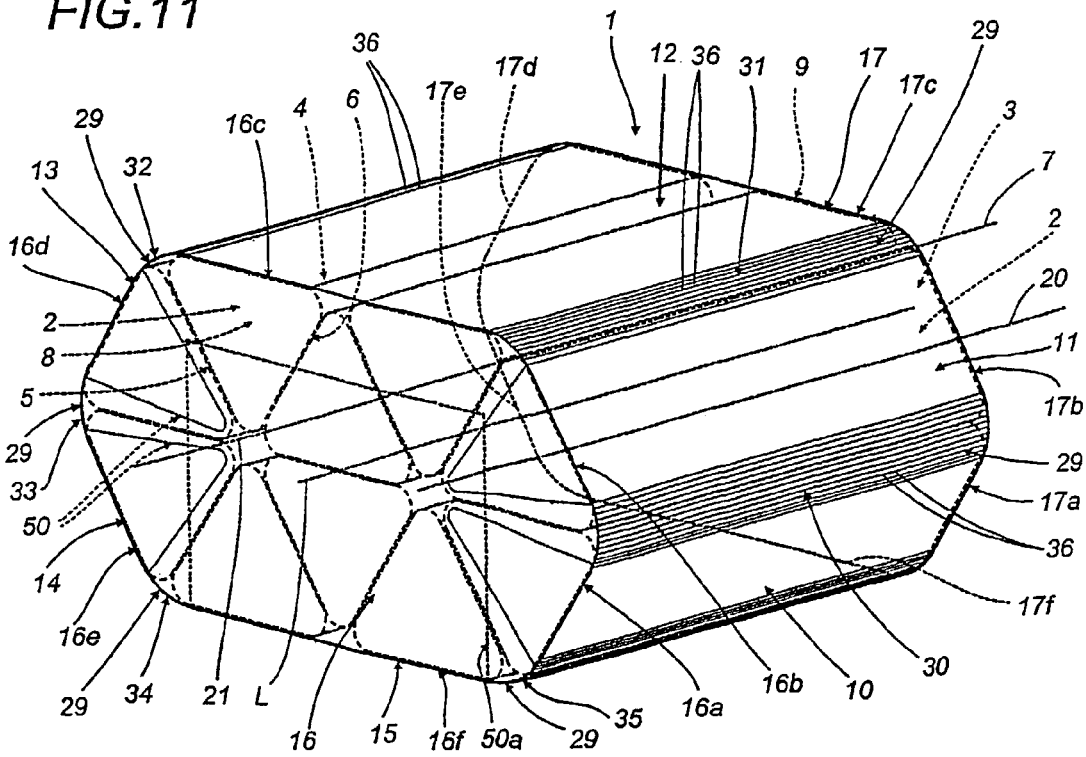

In the various examples of FIGS. 3, 9 and 11, the packets 2 are arranged inside the wrapper 1 in such a manner as to form two groups, each centred on a respective axis 20 and 21 extending parallel with the predominating longitudinal axis L. In this instance the packets are ten in number and the two groups have two packets 2 in common.

In the examples of FIGS. 5 and 9, both of the wrappers 1 appear with the six side faces 10, 11, 12, 13, 14 and 15 joined one to the next by way of bevelled corner edges 22 identifiable as six flat longitudinal interconnecting fillets 23, 24, 25, 26, 27 and 28: the first such fillet 23 interposed between the faces denoted 10 and 11, the second fillet 24 between the faces denoted 11 and 12, the third fillet 25 between the faces denoted 12 and 13, the fourth fillet 26 between the faces denoted 13 and 14, the fifth fillet 27 between the faces denoted 14 and 15, and the sixth fillet 28 between the faces denoted 15 and 10.

In the examples of FIGS. 7 and 11, both of the wrappers 1 appear with the six side faces 10, 11, 12, 13, 14 and 15 joined likewise one to the next by way of rounded corner edges 29, identifiable as six longitudinal interconnecting bands 30, 31, 32, 33, 34 and 35 rendered pliable by a plurality of longitudinal and mutually parallel crease lines 36: the first such band 30 interposed between the faces denoted 10 and 11, the second band 31 between the faces denoted 11 and 12, the third band 32 between the faces denoted 12 and 13, the fourth band 33 between the faces denoted 13 and 14, the fifth band 34 between the faces denoted 14 and 15, and the sixth band 35 between the faces denoted 15 and 10.

Figure 13:
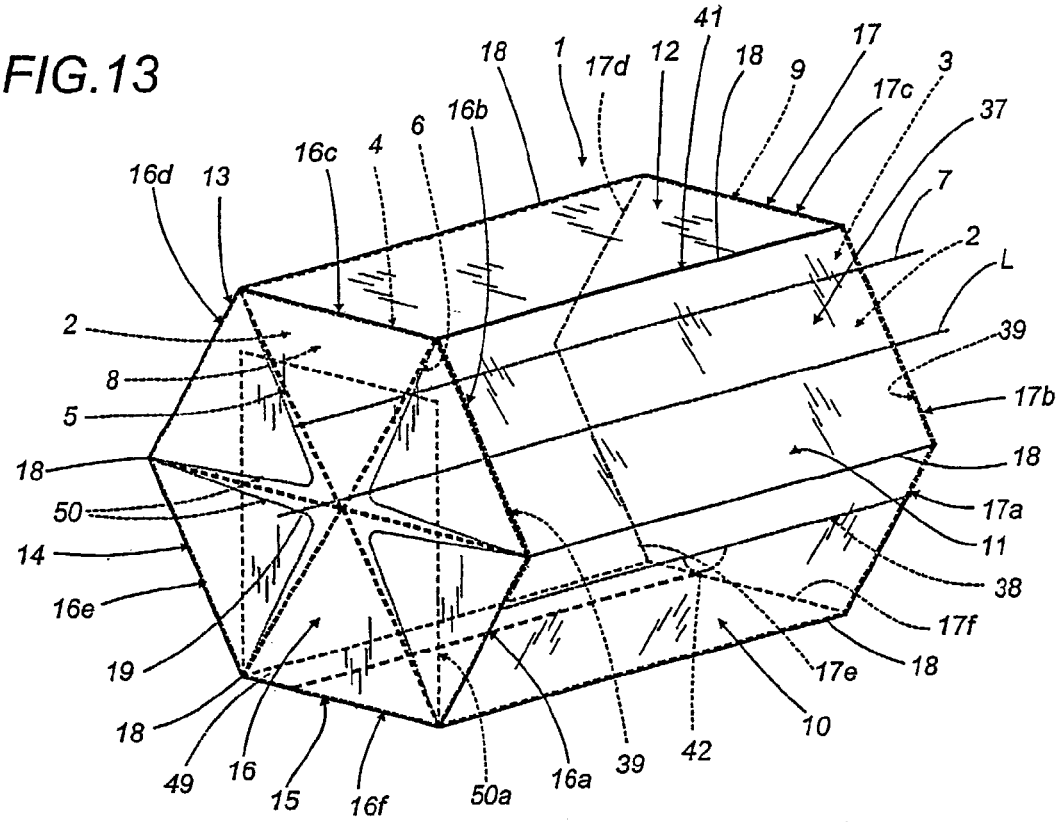
FIGS. 13, 14 and 15 show two further alternative embodiments of the wrapper of FIG. 1, viewed in perspective.
Figure 14:
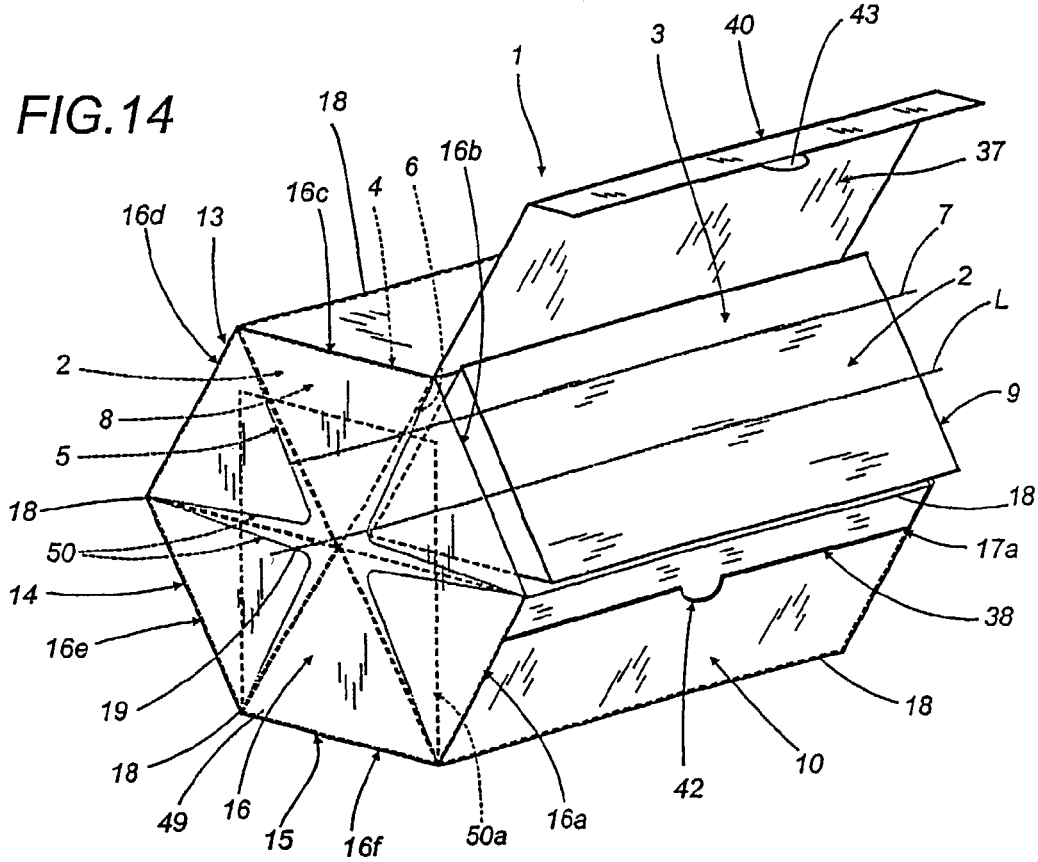

In the example of FIGS. 13 and 14 the wrapper 1 is fashioned with an access portion 37 defined by a longitudinal perforation line 38 extending along the side face denoted 10, located near the corner edge 18 along which this face 10 is joined to the adjacent face 11, and two transverse perforation lines 39 coinciding with the corner edges of the two end faces 16 and 17, which extend from the two longitudinal extremities of the first line 38 to the corner edge 18 along which the two side faces denoted 11 and 12 are joined. More precisely, the two transverse perforation lines 39 occupy a part of the side face 10 occupied by the longitudinal perforation line 38, and all of the adjacent side face 11 up to the corner edge 18 along which this face 11 is joined to the adjacent face 12 on the opposite side of the selfsame face 11 from the first face 10.

The access portion 37 functions as a lid 40, consisting in the portion of the one side face 10 delimited by the first perforation line 38 together with the adjoining side face 11; at the moment of opening the wrapper 1, once the user has effected a break along the perforation lines 38 and 39, the lid can be rotated about a hinge line 41 coinciding with the corner edge 18 between the two side faces denoted 11 and 12 between a closed position shown in FIG. 13 and an open position, illustrated in FIG. 14, in which the user is able to take hold of a packet 2 and extract it from the wrapper 1. To facilitate the operation of opening the lid 40, the first perforation line 38 includes a semicircular cut 42 positioned substantially halfway along its length and serving to create a tab 43.

Figure 15:
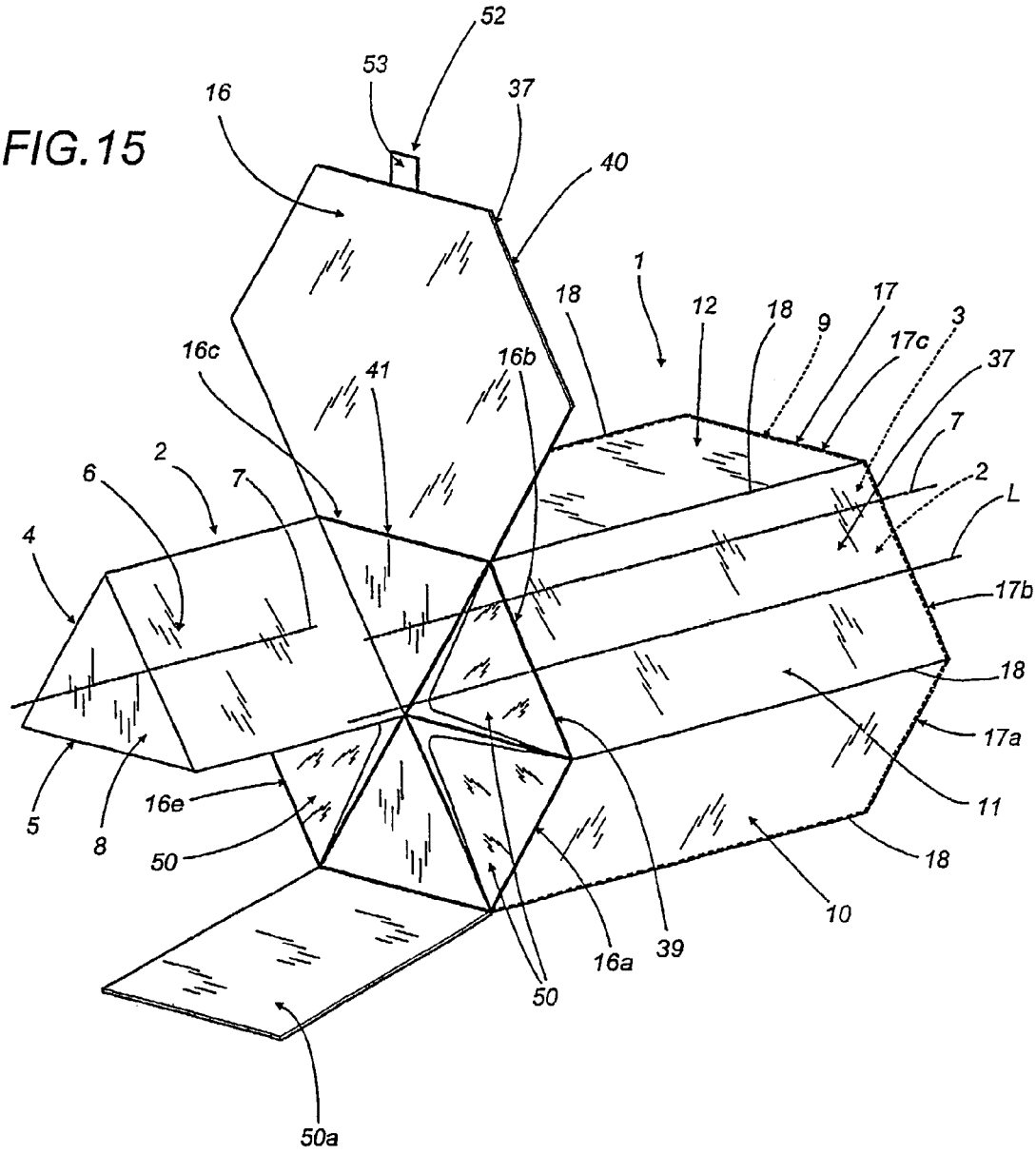

In the example of FIG. 15, the aforementioned access portion 37 coincides with one of the two end faces 16 and 17 and, more exactly, the end face 16 connected along one side 16*c* to the side face 12 uppermost in the drawing by way of a relative hinge line 41 coinciding with the corner edge between the two faces 16 and 12.

As in the examples of FIGS. 13 and 14, the access portion 37 of the embodiment in FIG. 15, which is one and the same as the corresponding end face 16, can be rotated between a closed position (not illustrated) and a position in which the end face of the wrapper 1 is open, allowing the user to extract one of the packets 2 by inducing movement along its axis 7 in relation to the other packets of the group.

In particular, the wrapper 1 of FIG. 15 is furnished with means 52 by which to secure the end face 16 in the closed position; such means might consist in a strip of restickable type adhesive tape positioned to engage the side face 15 of the wrapper 1 opposite from the side face to which the end face 16 is hinged, thereby allowing the access portion 37 to be opened and fastened again several times over.

It will be noted that a portion of adhesive tape of the type might also be used for the wrapper 1 illustrated in FIGS. 13 and 14, in place of the tab 43.

Turning now to FIGS. 2, 4, 6, 8, 10 and 12, the wrapper 1 is fashioned from a flat diecut blank 44 of wrapping material, of which the component parts will be indicated where possible using the same numbers, primed, as those used to indicate the corresponding parts of the wrapper 1.

The blank 44 is substantially rectangular, with an axis of symmetry 45 disposed transversely to the predominating longitudinal axis L, and presents two transverse crease lines 46 and 47 disposed parallel one to another and both to the axis of symmetry 45, along which corresponding bends will be made, also six longitudinal precreased areas 48 all extending parallel one to another and to the predominating longitudinal axis L, along which further bends are made, defining six longitudinal panels 10', 11', 12', 13', 14' and 15' between the transverse crease lines 46 and 47, coinciding respectively with the six side faces 10, 11, 12, 13, 14 and 15 of the wrapper 1, and a longitudinal connecting flap 49.

Throughout the specification, in the interests of clarity, the panel denoted 12' will be referred to as a "central panel" and the panels 11' and 13' on either side of the central panel 12' as "lateral panels", whilst the panels 10' and 14' connected by way of relative precreased areas 48 respectively to the lateral panel 11' on the right of the central panel 12' and to the lateral panel 13' on the left of the central panel 12' are referred to as "outer panels", and the remaining panel 15', connected to the adjoining outer panel 10' by way of a relative precreased area 48, is referred to as an end panel. The longitudinal flap 49 is connected by way of a relative precreased area 48 to the remaining outer panel 14'.

The central panel 12' is associated at each end with relative end folds 16' and 17' of essentially polygonal outline, located beyond and joined to the panel 12' by way of the two respective transverse crease lines 46 and 47, whilst the remaining panels 11', 13', 10', 14' and 15' are associated similarly with respective end flaps 50 and 50*a*.

Figure 2:
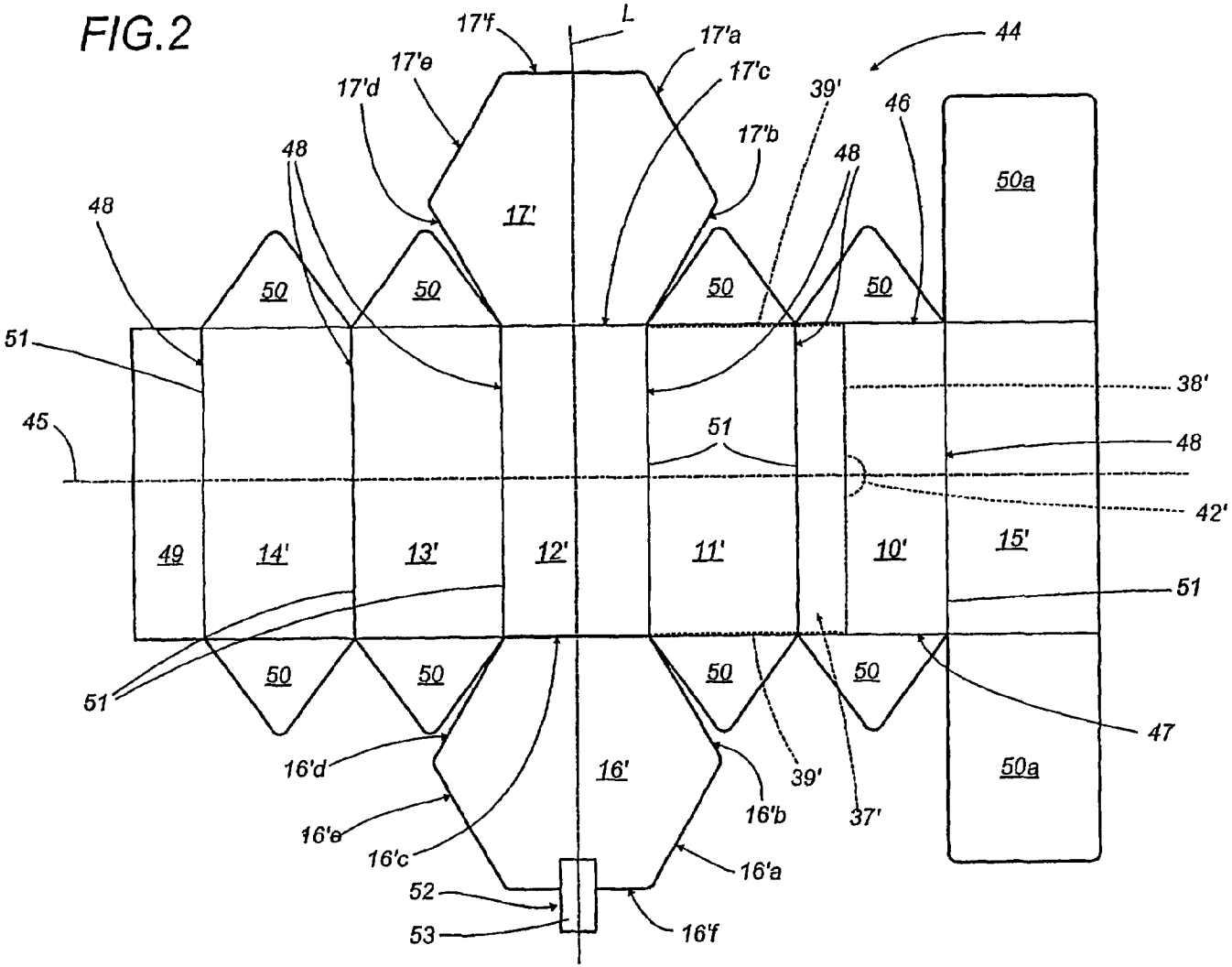
FIG. 2 is the plan view of a diecut blank used to fashion the wrapper of FIG. 1 and the wrappers of FIGS. 13, 14 and 15.
Figure 4:
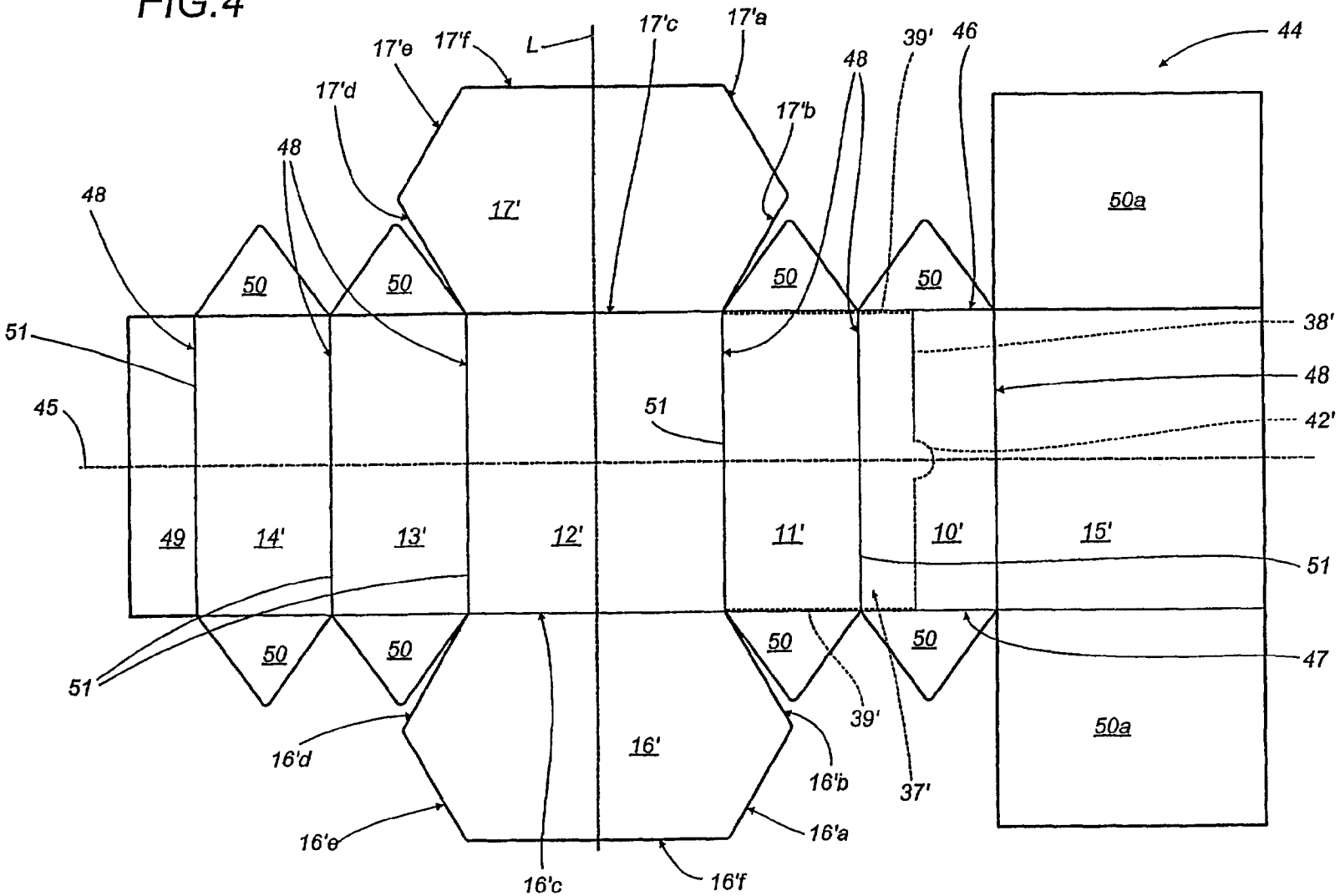
FIG. 4 is the plan view of a diecut blank used to fashion the wrapper of FIG. 3.

More exactly, observing the blank 44 illustrated in FIG. 2, which corresponds to the wrapper 1 of FIG. 1, the aforementioned end folds 16' and 17' appear as regular hexagons of which the respective sides 16'*a*-17'*a*, 16'*b*-17'*b*, 16'*c*-17'*c*, 16'*d*-17'*d*, 16'*e*-17'*e* and 16'*f*-17'*f* are all identical in length one to another, and the six panels 10', 11' . . . 15' all exhibit the same transverse dimension, whereas observing the blank 44 illustrated in FIG. 4, which corresponds to the wrapper 1 of FIG. 3, the end folds 16' and 17' appear as irregular hexagons of which the respective sides 16'*c*-17'*c* along which the end folds 16' and 17' are joined to the central panel 12', and the sides 16'*f*-17'*f* lying opposite from and parallel to the joined sides 16'*c*-17'*c*, are double the length of the remaining sides 16'*a*-17'*a*, 16'*b*-17'*b*, 16'*d*-17'*d* and 16'*e*-17'*e*, and the transverse dimension of the corresponding central panel 12' and end panel 15' is double that of the remaining panels 10', 11', 13' and 14'.

In particular, both of the blanks 44 illustrated in FIGS. 2 and 4 appear with precreased areas 48 consisting in respective crease lines 51 positioned to coincide with the sharp corner edges 18 of the erected wrapper 1. Accordingly, the vertexes of the two end folds 16' and 17' appear as well defined obtuse angles, the end flaps 50 associated with the lateral panels 11' and 13' and the outer panels 10' and 14' are of substantially triangular shape, and the end flaps 50*a* associated with the end panel 15' present a substantially rectangular outline. In the finished wrapper 1, after the six panels 10' . . . 15' and the longitudinal connecting flap 49 have been bent along the respective crease lines 51 through an angle compassed by two adjoining sides of the respective end folds 16' and 17', the triangular end flaps 50 bent at right angles to the respective panels 10', 11', 13', and 14', the remaining end flaps 50*a* bent at right angles to the end panel 15' and finally the end folds 16' and 17' bent at right angles to the central panel 12', the end flaps 50 will be affixed to the inside surfaces of the end folds 16' and 17', creating the end faces 16 and 17 of the wrapper 1, whilst the longitudinal flap 49 will be affixed to a portion of the inside surface presented by the end panel 15'.

The blanks 44 illustrated in FIGS. 2 and 4 also present a first longitudinal perforation line 38' lying parallel to the predominating longitudinal axis L and occupying the outer panel denoted 10', and two transverse perforation lines 39' located to coincide with the transverse crease lines 46 and 47, which extend from the longitudinal extremities of the first perforation line 38' along the full width of the adjoining lateral panel 11 up to the crease line 51 along which this same panel 11' is joined to the central panel 12', thus creating the access portion 37' which establishes a lid 40 as illustrated in FIGS. 13 and 14, that is, hinged on a line 41 coinciding with the corner edge 18 along which the two relative side faces 11 and 12 are joined.

In particular, the first perforation line 38' presents a semicircular cut 42' located at a point half way along its length, which serves to create the aforementioned tab 43 on the lid 40.

When manufacturing a wrapper 1 as in the example of FIG. 15, moreover, the end fold 16' can be furnished with securing means 52 located along the side 16'*f* opposite the hinge and serving to retain the end face 16 in the closed position, which might consist in a length of restickable type adhesive tape such as will cling detachable to the face 15 of the wrapper 1 opposite from that to which the end face 16 is hinged; with this arrangement, the access portion 37 afforded by the end fold 16' can be opened and fastened again several times.

In this embodiment, the end flaps 50 and 50*a* need not be affixed to the inside surface of the end fold 16'.

Figure 6:
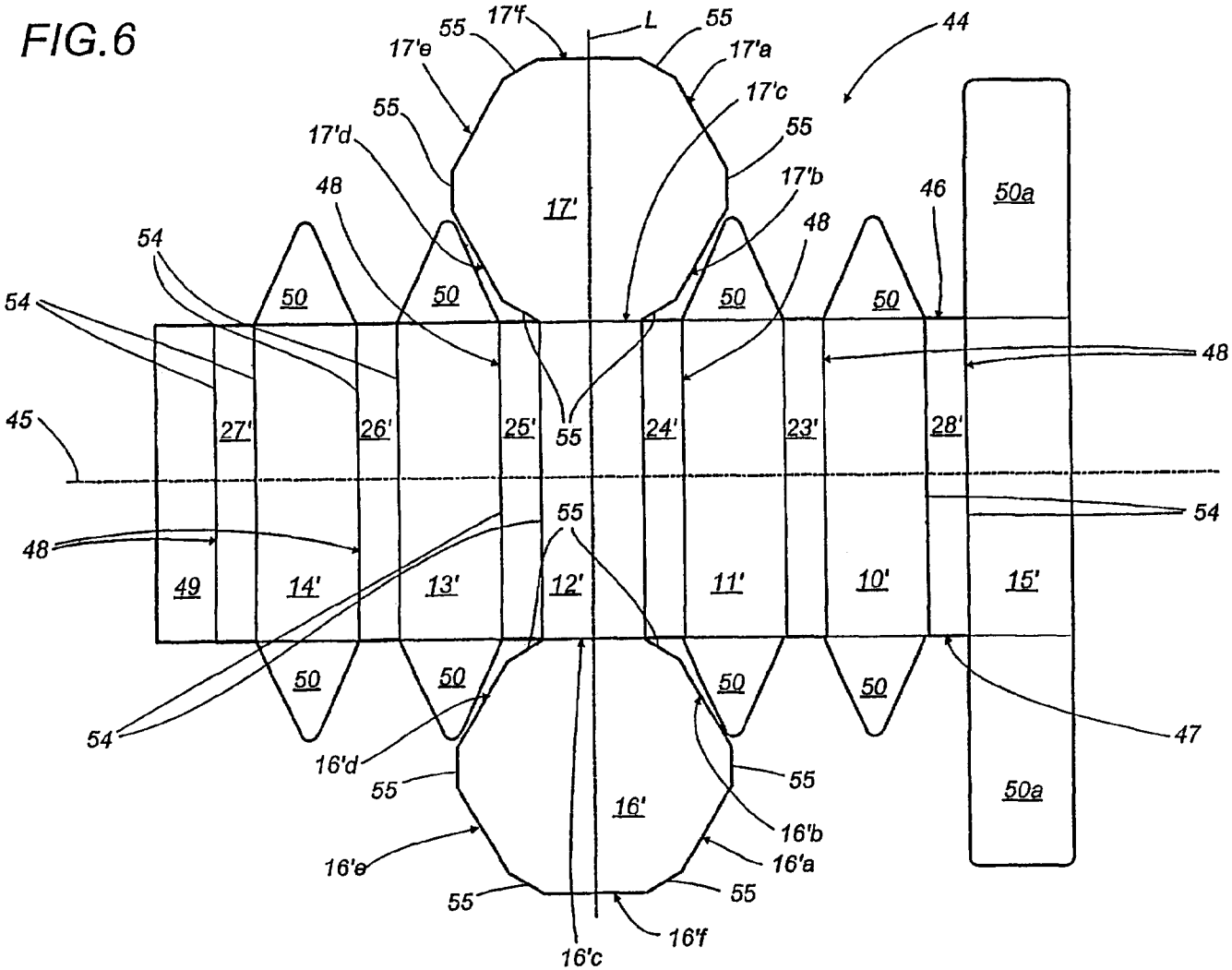
FIGS. 6 and 8 are plan views of diecut blanks used to fashion the wrappers of FIGS. 5 and 7.
Figure 10:
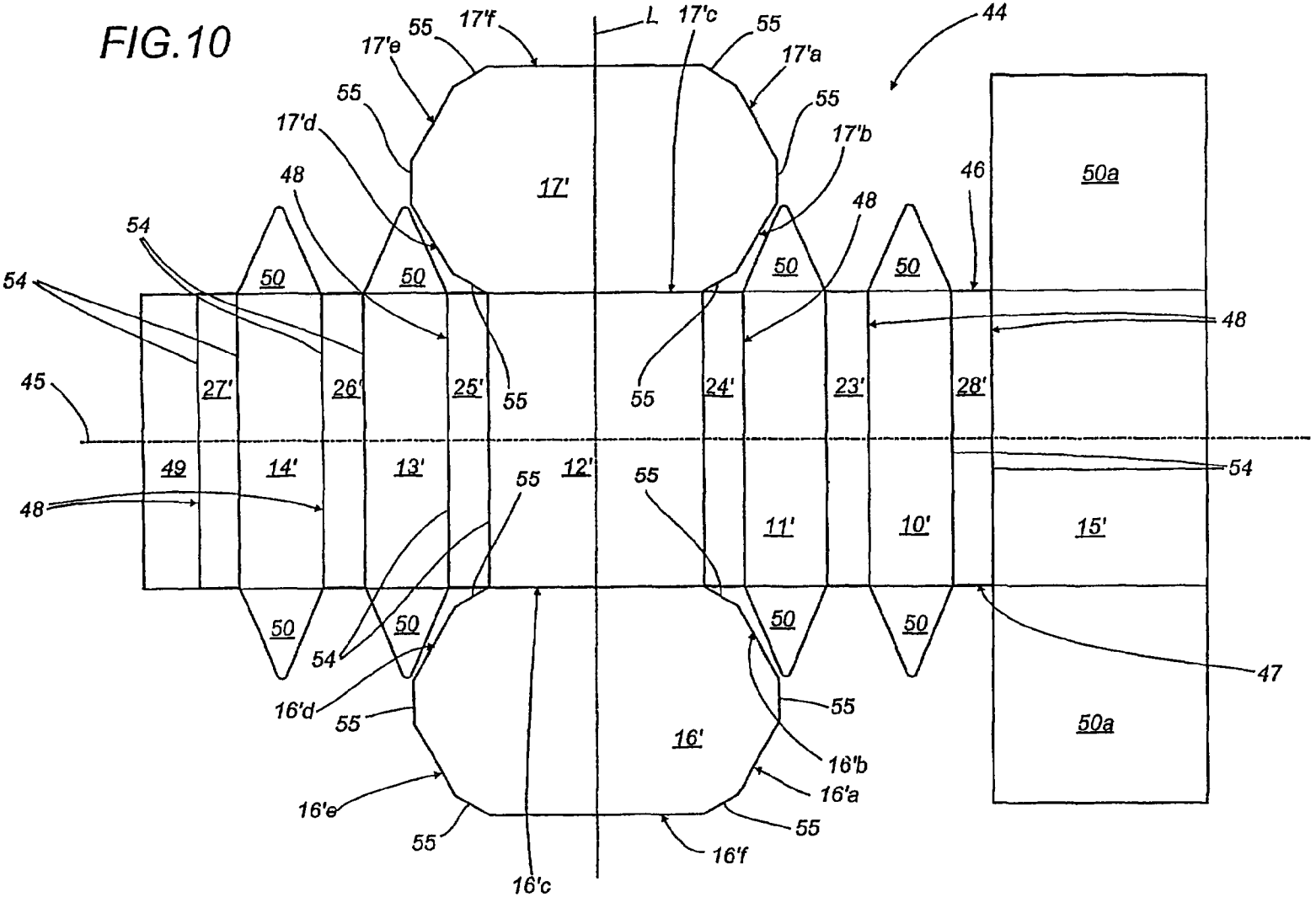
FIGS. 10 and 12 are plan views of diecut blanks used to fashion the wrappers of FIGS. 9 and 11.

The blanks 44 illustrated in FIGS. 6 and 10 are used to fashion the wrappers 1 of FIGS. 5 and 9 respectively, intended in particular to accommodate packets 2 of which the longitudinal corner edges are bevelled (not illustrated) or rounded.

The blank 44 of FIGS. 6 and 10 is similar to the blank 44 illustrated in FIGS. 2 and 4, while differing most significantly in that the precreased bend areas 48 each comprise two mutually parallel crease lines 54 separated one from another by a first predetermined distance, thereby generating six longitudinal fillets 23', 24', 25', 26', 27' and 28' by way of which the six panels 10' . . . 15' are joined one to another, and the longitudinal flap 49 to the adjacent outer panel 14'. More exactly, a first longitudinal fillet 23' is interposed between the panels denoted 10' and 11', a second fillet 24' between the panels denoted 11' and 12', a third fillet 25' between the panels denoted 12' and 13', a fourth fillet 26' between the panels denoted 13' and 14', a fifth fillet 27' between the latter panel 14' and the longitudinal flap 49, and a sixth fillet 28' between the panels denoted 15' and 10'. The six fillets 23' . . . 28', which present a slender transverse dimension, are identical one to another and arranged in such a manner as to constitute the aforementioned bevelled corner edges 22 of the erected wrapper 1, appearing as six longitudinal flat fillets 23, 24, 25, 26, 27 and 28 by which the six side faces 10, 11, 12, 13, 14 and 15 are joined one to the next.

Accordingly, each end fold 16' and 17' appears with the vertexes clipped by respective rectilinear connecting profiles 55 located one between each two adjoining sides, whilst the end flaps 50 and 50*a* are connected to the respective panels along the corresponding transverse crease lines 46 and 47 in such a way that the longitudinal extremities of the fillets 23' . . . 28' remain free.

More particularly, the length of the rectilinear connecting profile 55 between each two adjoining sides of the end folds 16' and 17' is substantially identical to the first distance between the two crease lines 54 of each precreased area 48, so that when the wrapper 1 is erected, the longitudinal extremities of the fillets 23' . . . 28' will be offered, though not connected, to the matching rectilinear profiles 55 of the end folds 16' and 17'.

Figure 8:
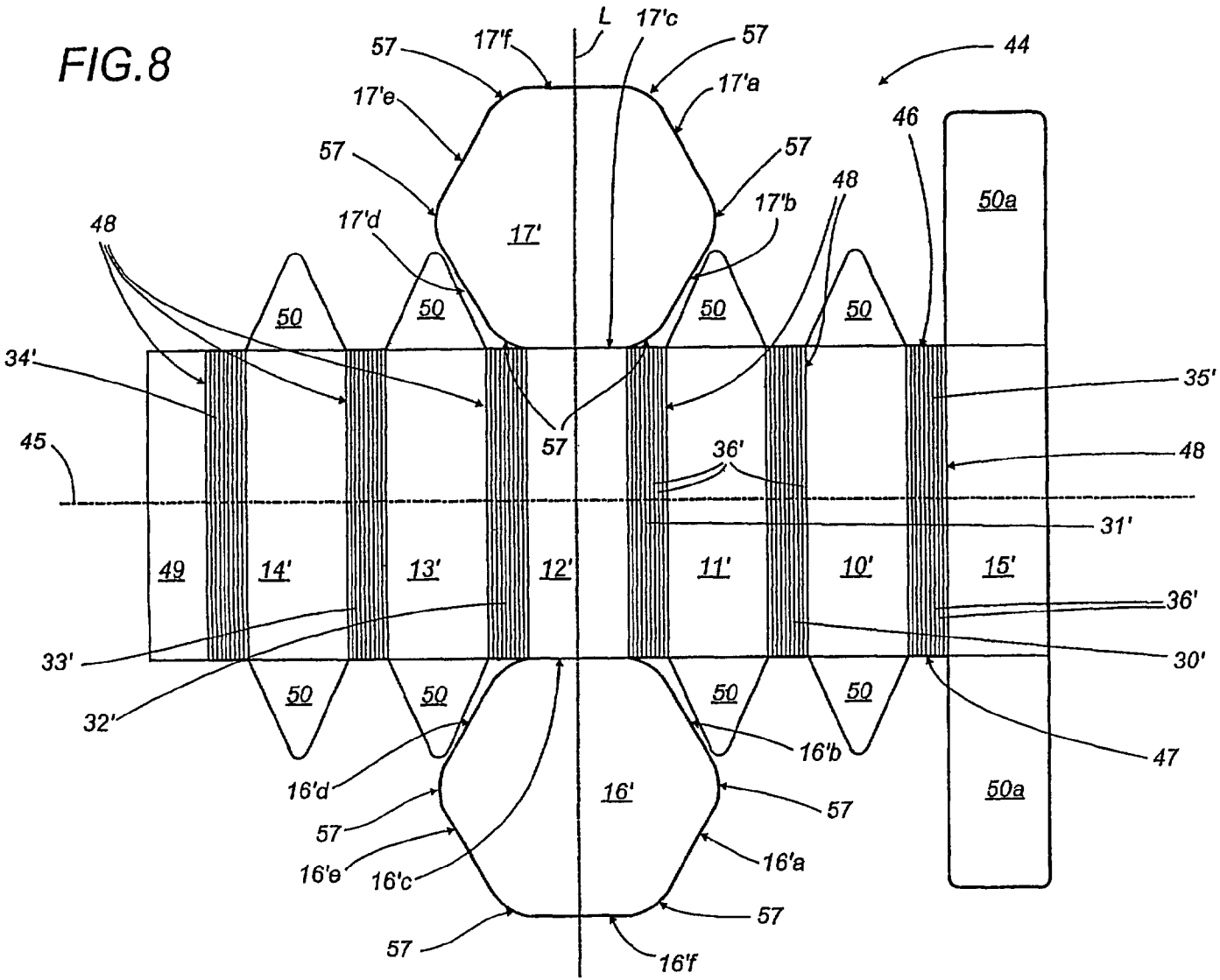
Figure 12:
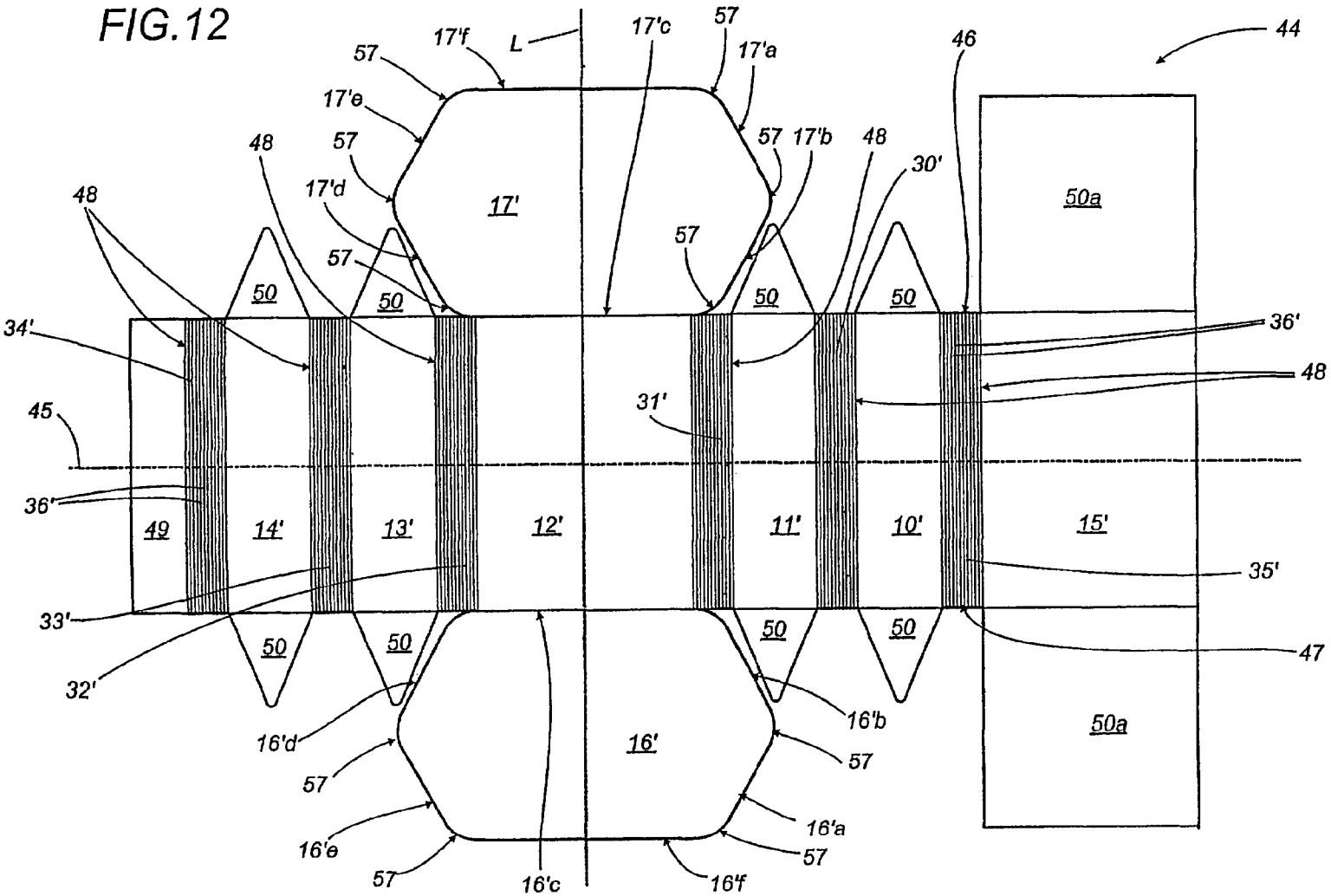

The blanks 44 illustrated in FIGS. 8 and 12 are used to fashion the wrappers 1 of FIGS. 7 and 11 respectively, intended in particular to accommodate packets 2 of which the longitudinal corner edges are bevelled (not illustrated) or rounded.

The blank 44 of FIGS. 8 and 12 is similar to the blank 44 illustrated in FIGS. 2 and 4, while differing significantly in that each precreased bend area 48 comprises a plurality of mutually parallel crease lines 36' compassed by a second predetermined distance, thereby generating six longitudinal bands 30', 31', 32', 33', 34' and 35' by way of which the six panels 10' . . . 15' are joined one to another, and the longitudinal flap 49 to the adjacent outer panel 14'. More exactly, a first such longitudinal band 30' is interposed between the panels denoted 10' and 11', a second band 31' between the panels denoted 11' and 12', a third band 32' between the panels denoted 12' and 13', a fourth band 33' between the panels denoted 13' and 14', a fifth band 34' between the latter panel 14' and the longitudinal flap 49, and a sixth band 35' between the panels denoted 15' and 10'. The six longitudinal bands 30' . . . 35', which present a slender transverse dimension, are identical one to another and arranged in such a manner as to constitute the aforementioned rounded corner edges 29 of the erected wrapper 1, appearing as six longitudinal precreased bands 30, 31, 32, 33, 34 and 35 by which the six side faces 10, 11, 12, 13, 14 and 15 are joined one to the next.

Accordingly, each end fold 16' and 17' appears with the vertexes rounded by respective contoured connecting profiles 57 located one between each two adjoining sides, whilst the end flaps 50 and 50*a* are connected to the respective panels along the corresponding transverse crease lines 46 and 47 in such a way that the longitudinal extremities of the bands 30' . . . 35' remain free.

More particularly, the length of the contoured connecting profile 57 between each two adjoining sides of the end folds 16' and 17' is substantially identical to the second distance compassing the plurality of crease lines 36' in each precreased area 48, so that when the wrapper 1 is erected, the longitudinal extremities of the fillets 23' . . . 28' will be offered, though not connected, to the matching contoured profiles 57 of the end folds 16' and 17'.

It will be noted that the wrappers 1 illustrated in FIGS. 5 and 7 and in FIGS. 9 and 11 can also be furnished with a respective access portion 37 (not illustrated) similar to that of the wrapper 1 illustrated in FIGS. 13, 14 and 15, created in like manner with a first longitudinal perforation line 38 extending along one face 10 and located respectively near to the bevelled corner edge 22 or to the rounded corner edge 29 along which this same face 10 is joined to the adjacent face 11, and two transverse perforation lines 39 coinciding with the corner edges of the two end faces 16 and 17, which extend from the two longitudinal extremities of the first line 38 to the bevelled corner edge 22 or the rounded corner edge 29, respectively, along which the relative face 11 is joined to the adjacent side face 12.

More precisely, the two transverse perforation lines 39 occupy a part of the side face 10 occupied by the longitudinal perforation line 38, and all of the adjacent side face 11 up to the bevelled corner edge 22 or rounded corner edge 29, respectively, along which this face 11 is joined to the adjacent face 12 on the side remote from the first face 10.

Again, similarly to the wrappers 1 illustrated in FIGS. 5, 7, 9 and 11, the access portion 37 can be afforded by one of the two end faces 16 and 17, as illustrated in FIG. 15.

To further advantage, with the introduction of the fillets 23' . . . 28' into the blanks 44 of FIGS. 6 and 10, and of the bands 30' . . . 35' into the blanks 44 of FIGS. 8 and 12, it becomes possible not only to fashion a wrapper 1 with bevelled corner edges 22 or rounded corner edges 29 and thus accommodate packets 2 similarly exhibiting bevelled or rounded corner edges, but also to reduce the width of the six panels 10' . . . 15' in comparison to those of the blanks 44 illustrated in FIGS. 2 and 4 and the corresponding wrappers 1 of FIGS. 1 and 3, with the result that the blanks 44 of FIGS. 6 and 10 and FIGS. 8 and 12 present a smaller transverse dimension overall.

The invention claimed is:

1. A rigid wrapper, comprising:

a plurality of side faces;

two end faces;

an access portion;

a hinge line hingeably connecting the access portion to one of the side faces such that the access portion is movable between open and closed positions, wherein in the open position, the access portion allows access to an interior of the wrapper for removal of each of the separate individual packs from the wrapper;

a first longitudinal perforation line positioned on another side face of the wrapper and separable to form a longitudinal free edge of the access portion;

two transverse perforation lines, extending orthogonally to the longitudinal axes, coinciding with corner edges of the two end faces, extending from two longitudinal extremities of the first longitudinal perforation line to the hinge line and separable to form transverse free edges of the access portion;

a plurality of separate individual packets of cigarettes positioned within the wrapper, referable to a predominating longitudinal axis extending parallel to longitudinal axes of the packets of cigarettes;

wherein the container has a prismatic shape of polygonal section and;

wherein, each packet of cigarettes extends an entire length between the two end faces, at least one of the packets of cigarettes has at least one face having a substantially same size and shape as the rigid wrapper side face that is exposed by the access portion, and the access portion exposes an entirety of the rigid wrapper side face such that the packet of cigarettes having a face substantially the same size and shape as the rigid wrapper side face can be inserted and withdrawn from the rigid wrapper free of interference by the rigid wrapper side face.

2. A wrapper as in claim 1, wherein the section is of hexagonal shape.

3. A wrapper as in claim 1, wherein the section is of regular hexagonal shape.

4. A wrapper as in claim 1, wherein the packets of cigarettes present a prismatic shape of substantially triangular section.

5. A wrapper as in claim 4, wherein the packets are disposed internally of the wrapper ordered in contact one with another and in such a manner as to form at least one group centered on an axis coinciding with the axis of the wrapper.

6. A wrapper as in claim 1, comprising at least one beveled longitudinal corner edge.

7. A wrapper as in claim 1, comprising at least one rounded longitudinal corner edge.

8. A wrapper as in claim 1, fashioned from a flat diecut blank of wrapping material having an axis of symmetry disposed transversely to the predominating longitudinal axis and exhibiting two transverse crease lines, also a plurality of precreased bend areas extending parallel to the longitudinal axis and defining a plurality of longitudinal panels, encompassed between the transverse crease lines and coinciding with side faces of the wrapper, and at least one longitudinal connecting flap, of which at least one longitudinal panel is associated at the two longitudinal ends with respective end flaps connectable to and combining with respective end folds to form the end faces of the wrapper.

9. A wrapper as in claim 8, wherein the end folds are of hexagonal shape.

10. A wrapper as in claim 8, wherein the end folds are of irregular hexagonal shape.

11. A wrapper as in claim 8, wherein the end flaps are of substantially triangular shape at least in part and proportioned so as not to interfere one with another once bent and in contact with the respective end fold.

12. A wrapper as in claim 11, wherein at least two of the flaps, associated with the opposite ends of one panel, are of substantially rectangular shape.

13. A wrapper as in claim 8, wherein the precreased longitudinal bend areas comprise at least one crease line.

14. A wrapper as in claim 8, wherein: at least one of the precreased longitudinal bend areas comprises two mutually parallel crease lines separated by a first predetermined distance and generating at least one longitudinal fillet by way of which at least two adjacent panels are joined one to another; at least one vertex of each end fold having a rectilinear profile connecting two adjoining sides; each of the end flaps associated with the opposite ends of the two panels interconnected by the fillet being connected along one side to the respective panel by the transverse crease lines in such a way that the longitudinal extremities of the fillets remain free; and the length of the rectilinear connecting profile between the two adjoining sides of the end fold being substantially identical to the first distance separating the two crease lines of the precreased bend area so that when the wrapper is erected, the longitudinal extremities of the fillets are offered though not connected to the corresponding rectilinear profile of the end fold, and the fillet constitutes at least one beveled longitudinal corner edge of the wrapper.

15. A wrapper as in claim 8, wherein: at least one of the precreased longitudinal bend areas comprises a plurality of mutually parallel crease lines encompassed by a second predetermined distance and generating at least one longitudinal band by way of which at least two adjacent panels are joined one to another; at least one vertex of each end fold having a contoured profile connecting two adjoining sides; each of the end flaps associated with the opposite ends of the two panels interconnected by the band being connected along one side to the respective panel by the transverse crease lines in such a way that the longitudinal extremities of the fillets remain free; and the length of the rectilinear connecting profile between the two adjoining sides of the end fold is substantially identical to the second distance encompassing the crease lines of the precreased bend area so that when the wrapper is erected, the longitudinal extremities of the fillets is offered though not connected to the corresponding contoured profile of the end fold, and the fillet constitutes at least one longitudinal rounded corner edge of the wrapper.

16. A wrapper as in claim 8, fashioned from a flat diecut blank of material that includes a first longitudinal perforation line occupying at least one longitudinal panel, also two transverse perforation lines coinciding with the transverse crease lines, extending from the longitudinal extremities of the first perforation line and along the panel adjacent to that occupied by the first perforation line.

17. A wrapper as in claim 1, wherein each packet of cigarettes is prismatic in cross-section and has at least one face having a substantially same size and shape as the rigid wrapper side face that is exposed by the access portion.

18. A wrapper as in claim 17, wherein each packet of cigarettes is triangular in cross-section, the container has a prismatic shape of regular hexagonal section and there are six packets positioned within the container such the face of each packet having substantially the same size and shape as the rigid wrapper side face is positioned adjacent a respective side face of the wrapper.

19. A wrapper as in claim 18, wherein each packet of cigarettes is equilaterally triangular in cross-section and the packets are positioned in the wrapper such that two inward facing faces of each packet each directly face a face of an adjacent packet.

* * * * *